US006940231B2

(12) United States Patent
Rasmussen

(10) Patent No.: US 6,940,231 B2
(45) **Date of Patent: *Sep. 6, 2005**

(54) APPARATUSES FOR PROVIDING UNIFORM ELECTRON BEAMS FROM FIELD EMISSION DISPLAYS

(75) Inventor: Robert T. Rasmussen, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/852,319

(22) Filed: May 24, 2004

(65) Prior Publication Data

US 2004/0212315 A1 Oct. 28, 2004

Related U.S. Application Data

(60) Continuation of application No. 10/137,553, filed on May 2, 2002, which is a division of application No. 09/617,199, filed on Jul. 17, 2000, now Pat. No. 6,448,717.

(51) Int. Cl.[7] ..... H01J 1/62; H01J 21/10

(52) U.S. Cl. ..... 315/169.3; 313/306; 345/75.2

(58) Field of Search ..... 316/169.1–169.3; 313/238, 292, 306, 309, 336, 495, 497; 345/76–77, 75.2

(56) References Cited

U.S. PATENT DOCUMENTS

| | | | | |
|---|---|---|---|---|
| 3,656,146 A | 4/1972 | Mead | ..... | 345/13 |
| 4,178,531 A | 12/1979 | Alig | ..... | 313/409 |
| 4,450,387 A | 5/1984 | Reed et al. | ..... | 315/375 |
| 5,103,144 A | 4/1992 | Dunham | ..... | 315/366 |
| 5,399,946 A | 3/1995 | Son et al. | ..... | 315/382 |
| 5,410,218 A | 4/1995 | Hush | ..... | 315/169.1 |
| 5,567,929 A | 10/1996 | Ouimette | ..... | 250/284 VT |
| 5,581,159 A | 12/1996 | Lee et al. | ..... | 315/167 |
| 5,628,659 A | 5/1997 | Xie et al. | ..... | 445/3 |
| 5,628,661 A | 5/1997 | Kim et al. | ..... | 445/24 |

(Continued)

OTHER PUBLICATIONS

Curtin, "The Field Emission Display: A New Flat Panel Technology", 1991 IEEE, pps. 12–15.

*Primary Examiner*—Thuy V. Tran
(74) *Attorney, Agent, or Firm*—TraskBritt

(57) ABSTRACT

The invention includes field emitters, field emission displays (FEDs), monitors, computer systems and methods employing the same for providing uniform electron beams from cathodes of FED devices. The apparatuses each include electron beam uniformity circuitry. The electron beam uniformity circuit provides a grid voltage, $V_{Grid}$, with a DC offset voltage sufficient to induce field emission from a cathode and a periodic signal superimposed on the DC offset voltage for varying the grid voltage at a frequency fast enough to be undetectable by the human eye. The cathodes may be of the micro-tipped or flat variety. The periodic signal may be sinusoidal with peak-to-peak voltage of between about 5 volts and about 50 volts.

16 Claims, 7 Drawing Sheets

U.S. PATENT DOCUMENTS 5,653,619 A 8/1997 Cloud et al. ..... 445/24
5,656,886 A 8/1997 Westphal et al. ..... 313/495
5,656,887 A 8/1997 Voshell et al. ..... 313/496
5,656,892 A 8/1997 Zimlich et al. ..... 315/169.3
5,675,216 A 10/1997 Kumar et al. ..... 313/495
5,679,043 A 10/1997 Kumar ..... 445/24
5,686,791 A 11/1997 Kumar et al. ..... 313/495
5,703,435 A 12/1997 Kumar et al. ..... 313/495
5,739,522 A 4/1998 Oiumette ..... 250/214 VT
5,759,078 A 6/1998 Levine et al. ..... 250/214 VT
5,773,927 A 6/1998 Zimlich ..... 445/24
5,818,500 A 10/1998 Edwards et al. ..... 313/495
5,827,100 A 10/1998 Kim ..... 347/238
5,831,397 A 11/1998 Stevens et al. ..... 445/24
5,847,504 A 12/1998 Baldi ..... 435/200
5,847,515 A 12/1998 Lee et al. ..... 313/495
5,856,812 A 1/1999 Hush et al. ..... 313/495
5,920,154 A 7/1999 Hush ..... 345/75.1
6,084,345 A 7/2000 Janning ..... 315/169.1
6,144,144 A * 11/2000 Cleeves et al. ..... 313/309
6,144,350 A 11/2000 Fujii et al. ..... 345/74
6,252,348 B1 6/2001 Lee ..... 313/495
6,448,717 B1 9/2002 Rasmussen ..... 315/169.3
6,492,777 B1 12/2002 Hush ..... 315/169.3
6,657,376 B1 * 12/2003 Raina et al. ..... 313/496

* cited by examiner

APPARATUSES FOR PROVIDING UNIFORM ELECTRON BEAMS FROM FIELD EMISSION DISPLAYS

CROSS-REFERENCE TO RELATED APPLICATIONS

This application is a continuation of application Ser. No. 10/137,553, filed May 2, 2002, pending, which is a divisional of application Ser. No. 09/617,199, filed Jul. 17, 2000, now U.S. Pat. No. 6,448,717, issued Sep. 10, 2002.

BACKGROUND OF THE INVENTION

1. Field of the Invention

This invention relates to field emission display (FED) devices. More particularly, this invention relates to methods and apparatuses for improving beamlet uniformity in FED devices.

2. Description of the Related Art

Field emission display (FED) devices are an alternative to cathode ray tube (CRT) and liquid crystal display (LCD) devices for computer displays. CRT devices tend to be bulky with high power consumption. While LCD devices may be lighter in weight with lower power consumption relative to CRT devices, they tend to provide poor contrast with a limited angular display range. FED devices provide good contrast and wide angular display range and are lightweight with low power consumption. An FED device typically includes an array of pixels, wherein each pixel includes one or more cathode/anode pairs. Thus, it is convenient to use the terms "column" and "row" when referring to individual pixels or columns or rows within the array.

FIG. 1 illustrates a portion of an FED device 10 produced in accordance with conventional micro-tipped cathode structure. The FED device 10 includes a faceplate 12 and a baseplate 20, separated by spacers 32. The spacers 32 support the FED device 10 structurally when the region 34 in between the faceplate 12 and the baseplate 20 is evacuated. The faceplate 12 includes a glass substrate 14, a transparent conductive anode layer 16 and a cathodoluminescent layer or phosphor layer 18. The phosphor layer 18 may include any known phosphor material capable of emitting photons in response to bombardment by electrons.

The baseplate 20 includes a substrate 22 with a row electrode 24, a plurality of micro-tipped cathodes 26, a dielectric layer 28 and a column-gate electrode 30. The baseplate 20 is formed by depositing the row electrode 24 on the substrate 22. The row electrode 24 is electrically connected to a row of micro-tipped cathodes 26. The dielectric layer 28 is deposited upon the row electrode 24. A column-gate electrode 30 is deposited upon the dielectric layer 28 and acts as a gate electrode for the operation of the FED device 10.

The substrate 22 may be comprised of glass. The micro-tipped cathodes 26 may be formed of a metal such as molybdenum, or a semiconductor material such as silicon, or a combination of molybdenum and silicon. Micro-tipped cathodes 26 may also be formed with a conductive metal layer (not shown) formed thereon. The conductive metal layer may be comprised of any well-known low work function material.

The FED device 10 operates by the application of an electrical potential between the column electrode 30 or gate electrode 30 and the row electrode 24 causing field emission of electrons 36 from the micro-tipped cathode 26 to the phosphor layer 18. The electrical potential is typically a DC voltage of between about 30 and 110 volts. The transparent conductive anode layer 16 may also be biased (1–2 kV) to strengthen the electron field emission and to gather the emitted electrons toward the phosphor layer 18. The electrons 36 bombarding the phosphor layer 18 excite individual phosphors 38, resulting in visible light seen through the glass substrate 14.

The micro-tipped cathodes 26 of FED device 10 are three-dimensional structures which may be formed as evaporated metal cones or etched silicon tips. Micro-tipped cathodes 26 provide enhanced electric field strength by about a factor of four or five over the two-dimensional structure of the two-dimensional alternative FED device 40 (see FIG. 2). However, the two-dimensional structure of the alternative FED device 40 can be formed with planar films and photolithography.

Referring to FIG. 2, a portion of an alternative FED device 40 is shown in accordance with conventional flat cathode structure. FED device 40 includes a faceplate 42 and a baseplate 50 separated by spacers (not shown for clarity). The faceplate 42 may include a glass substrate 44, a transparent conductive anode layer 46 disposed over the glass substrate 44, and a phosphor layer 48 disposed over transparent conductive anode layer 46. An electrical potential of between about one kilovolt to about two kilovolts may be applied to the transparent conductive anode layer 46 to enhance field emission of electrons and to gather emitted electrons at the phosphor layer 48.

The baseplate 50 may include a substrate 52, a conductive layer 54, a flat cathode emitter 56, a dielectric layer 58 and a grid electrode 60. The conductive layer 54 may be a row electrode 54 and is deposited on the substrate 52. The flat cathode emitter 56 and dielectric layer 58 are deposited on the conductive layer 54. The grid electrode 60 may also be referred to as the column electrode 60. The grid electrode 60 is deposited over, and supported by, the dielectric layer 58. The flat cathode emitter 56 may comprise a low effective work function material such as amorphic diamond.

Several techniques have been proposed to control the brightness and gray scale range of FED devices. For example, U.S. Pat. No. 5,103,144 to Dunham, U.S. Pat. No. 5,656,892 to Zimlich et al. and U.S. Pat. No. 5,856,812 to Hush et al., incorporated herein by reference, teach methods for controlling the brightness and luminance of flat panel displays. However, even using these brightness control techniques, it is still very difficult to obtain a uniform electron beam from an FED emitter. Thus, there remains a need for methods and apparatuses for controlling FED beam uniformity.

BRIEF SUMMARY OF THE INVENTION

The present invention includes a field emitter circuit including a row electrode, at least one cathode structure on the row electrode, a grid electrode proximate to the at least one cathode structure and an electron beam uniformity circuit coupled to the grid electrode for providing a grid voltage sufficient to induce electron emission from the at least one cathode structure and with a periodically varying signal to provide electron beam uniformity.

A field emission display (FED) embodiment of the invention includes a faceplate, a baseplate and a circuit for controlling electron beam uniformity. The faceplate of this embodiment may include a transparent screen, a cathodoluminescent layer and a transparent conductive anode layer disposed between the transparent screen and the cathodoluminescent layer. The baseplate of this embodiment may include an insulating substrate, a row electrode disposed on the insulating substrate, a cathode structure disposed on the row electrode, an insulating layer disposed around the cathode structure and on the row electrode, and a column electrode disposed upon the insulating layer and proximate to the cathode structure. The cathode structure of this embodiment may be micro-tipped. In another embodiment, the cathode structure may be flat. The circuit for controlling electron beam uniformity provides a grid voltage including a periodic signal superimposed on a DC offset voltage. The DC offset voltage is sufficient to induce field emission of electrons from the cathode structure. The superimposed periodic signal provides electron beam uniformity.

An alternative embodiment of the present invention is a field emission display monitor including a video driver circuitry, a video monitor chassis for housing, and coupling to, the video driver circuitry and a field emission display coupled to the video driver circuitry and housed essentially within the monitor chassis. The field emission display may also include user controls coupled to the monitor chassis and in communication with the video driver circuitry. The field emission display includes an electron beam uniformity circuit.

A computer system embodiment of this invention includes an input device, an output device, a processor device coupled to the input device and the output device, and an FED coupled to the processor device.

The method according to this invention includes providing an FED device as described herein and varying the grid voltage with a periodic signal superimposed upon a DC offset voltage.

BRIEF DESCRIPTION OF THE SEVERAL VIEWS OF THE DRAWINGS

In the drawings, which illustrate what is currently regarded as the best mode for carrying out the invention and in which like reference numerals refer to like parts in different views or embodiments.

DETAILED DESCRIPTION OF THE INVENTION

Figure 1:
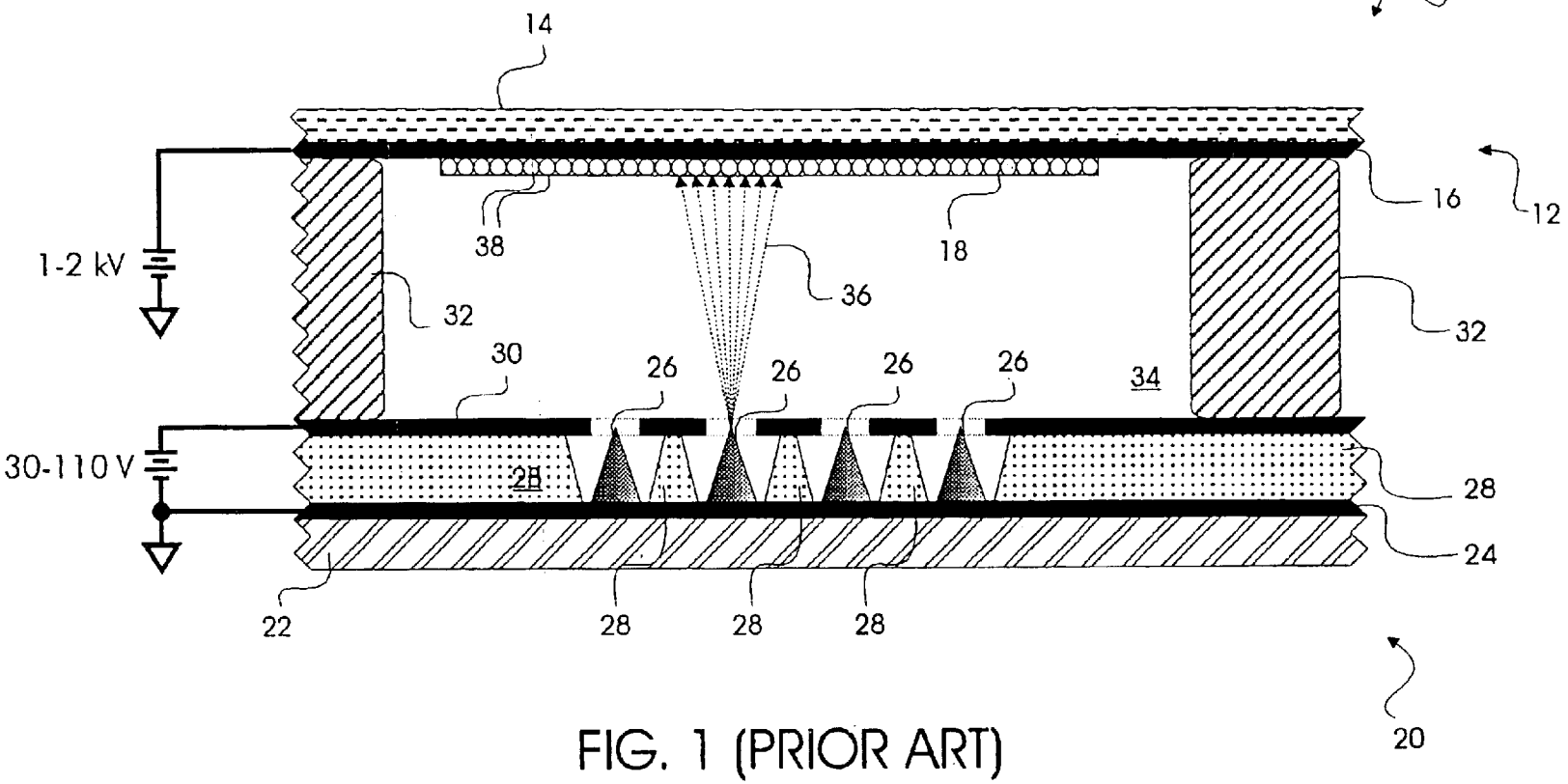
FIG. 1 (PRIOR ART)
FIG. 1 illustrates a portion of a structural cross-section of an array of micro-tipped cathode emitters in a conventional field emission display (FED) device.
Figure 2:
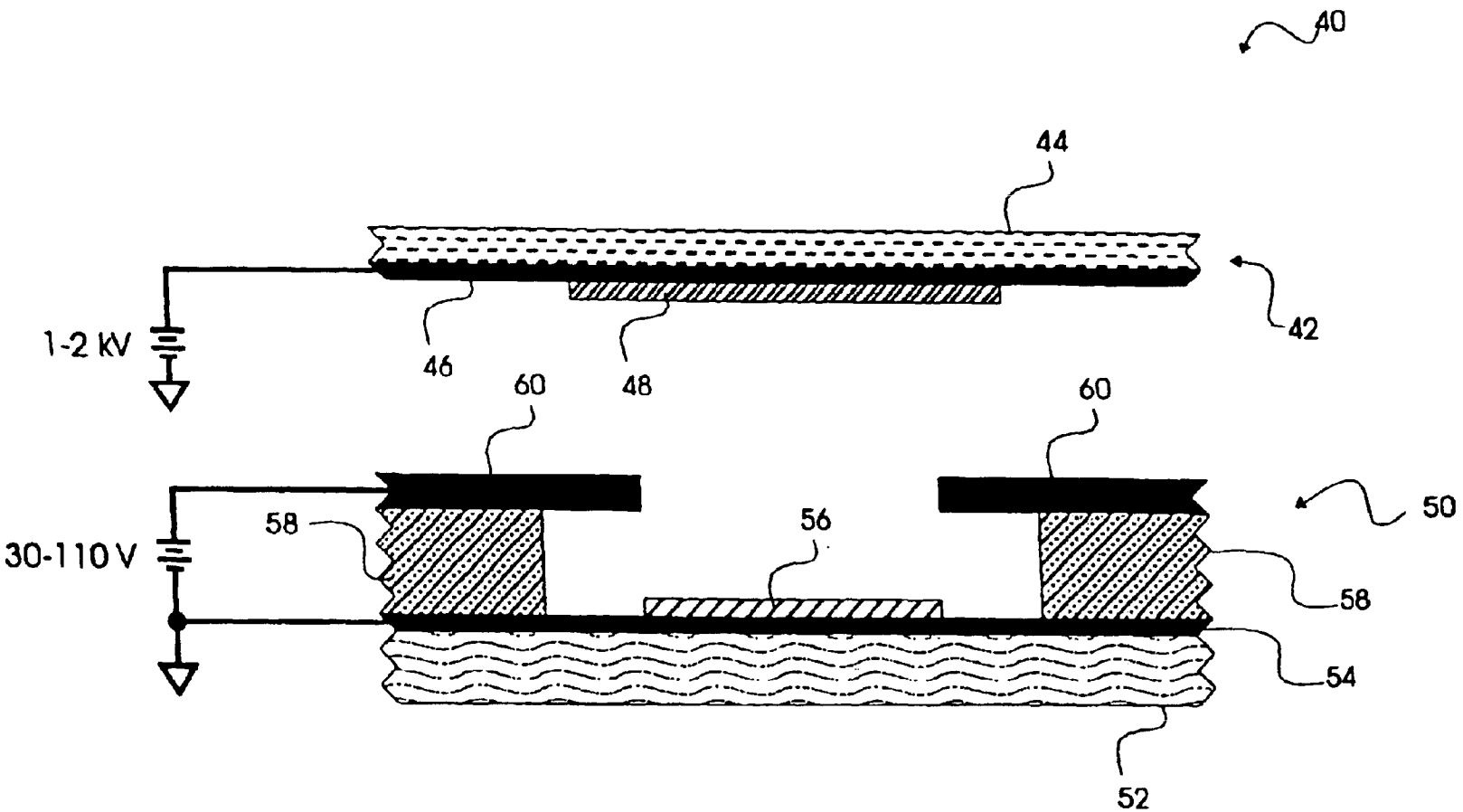
FIG. 2 (PRIOR ART)
FIG. 2 illustrates a portion of a structural cross-section of an array of flat cathode emitters in an alternative conventional FED device.
Figure 3:
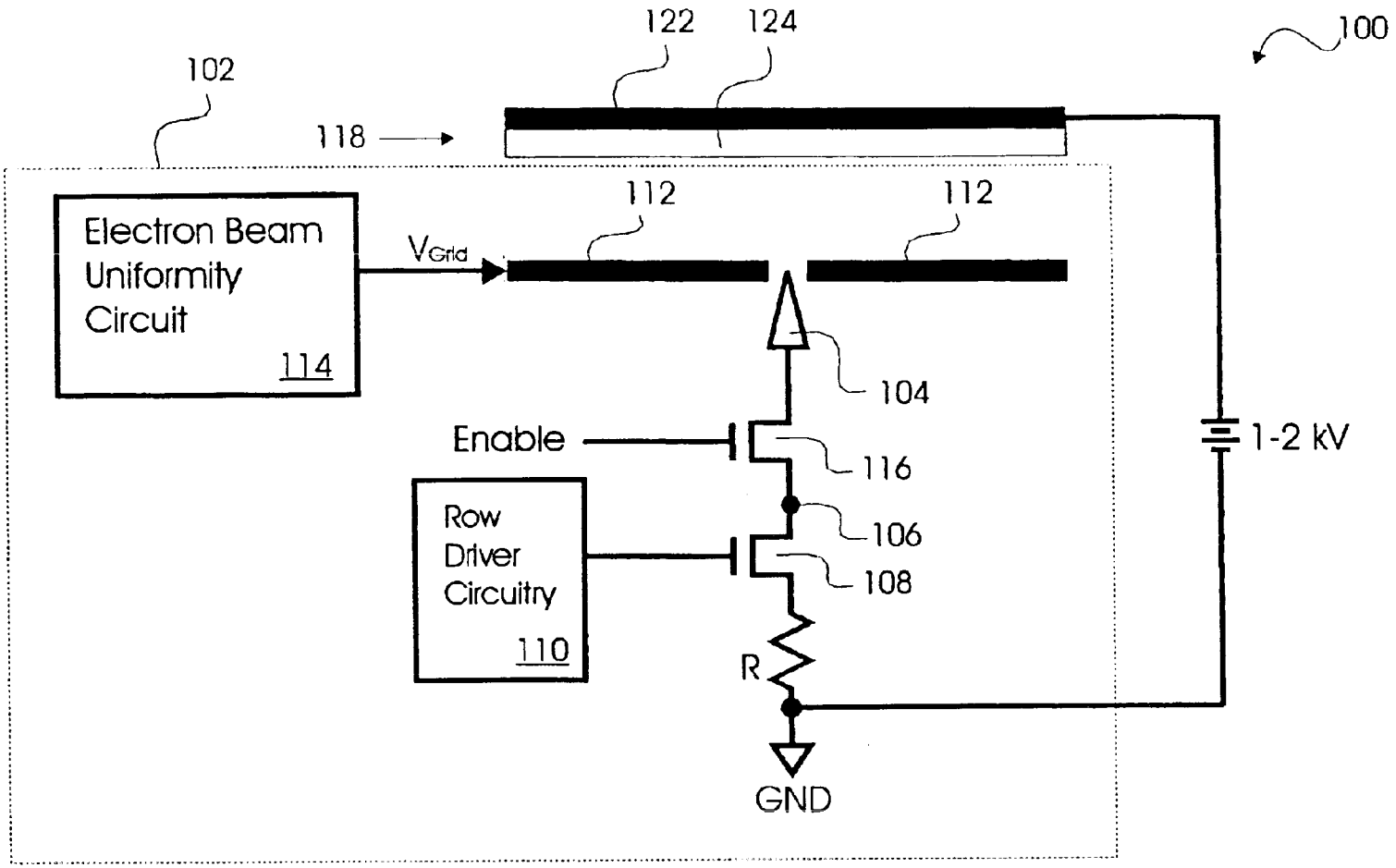
FIG. 3 is a schematic of a single emitter and FED in accordance with this invention.

Referring to FIG. 3, an emitter circuit 102, in accordance with this invention, is shown schematically as part of an FED 100. The emitter circuit 102 includes a cathode 104 with a row electrode 106 coupled to a switching element 108. The switching element 108 is driven by row driver circuitry 110. The emitter circuit 102 further includes a grid electrode 112 coupled to an electron beam uniformity circuit 114. The terms "grid electrode" and "column electrode" may be used interchangeably. The grid electrode 112 is shown in proximity to the cathode 104. Cathode 104 may be a micro-tipped cathode 26 as illustrated in FIG. 1. Alternatively, cathode 104 may be a flat cathode emitter 56 as illustrated in FIG. 2. The emitter circuit 102 may further include a switching element in series between the cathode 104 and the row electrode 106. The emitter circuit 102 additionally may further include a resistive element, R, in series between the switching element 108 and a ground potential, GND. The row driver circuitry 110 may include current and brightness control circuitry as described in U.S. Pat. No. 5,856,812 to Hush et al., U.S. Pat. No. 5,103,144 to Dunham and U.S. Pat. No. 5,656,892 to Zimlich et al.

The electron beam uniformity circuit 114 provides a grid voltage, $V_{Grid}$. The grid voltage, $V_{Grid}$, in conventional FED devices is typically a DC voltage of between about 30 volts and 110 volts relative to ground potential, GND. The grid voltage, $V_{Grid}$, of the present invention provides a periodic signal superimposed on a DC offset of between about 30 and 110 volts. The periodic signal is chosen with an operating frequency faster than detectable by the human eye. In what is currently considered to be the best mode of the invention, a frequency of about 50 Hertz or greater is sufficient to be undetectable by the human eye. The periodic signal may be sinusoidal, with peak-to-peak voltage excursions of between about 5 volts and 50 volts. Alternatively, the periodic signal may be a rectangular wave also with peak-to-peak variations of between about 5 volts and 50 volts. The duty cycle of the rectangular wave may be between about 10 percent and 90 percent. The circuitry comprising the electron beam uniformity circuit 114 for generating the grid voltage as described above is within the knowledge of one skilled in the art and thus, will not be further detailed.

FIG. 3 also schematically illustrates an FED 100 embodiment of the invention. FED 100 includes an emitter circuit 102 as described above and a faceplate 118. The faceplate 118 may include a transparent screen or glass substrate layer (not shown for clarity), a transparent conductive anode layer 122 (hereinafter "anode 122") and a cathodoluminescent layer or phosphor layer 124. An electrical potential of between about 500 volts to about 5000 volts may be applied to the transparent conductive anode layer 122 to enhance the field emission of electrons and gather the emitted electrons at the phosphor layer 124.

In operation, with switching devices 108 and 116 both on, the row electrode 106 is pulled to ground potential, GND, through resistor, R. The electrical potential, $V_{Grid}$, between the cathode 104 (row electrode 106) and the grid electrode 112 is sufficient to cause electron emission from the cathode 104. The emitted electrons may then be swept to the phosphor layer 124 causing illumination at the faceplate 118.

Figure 4:
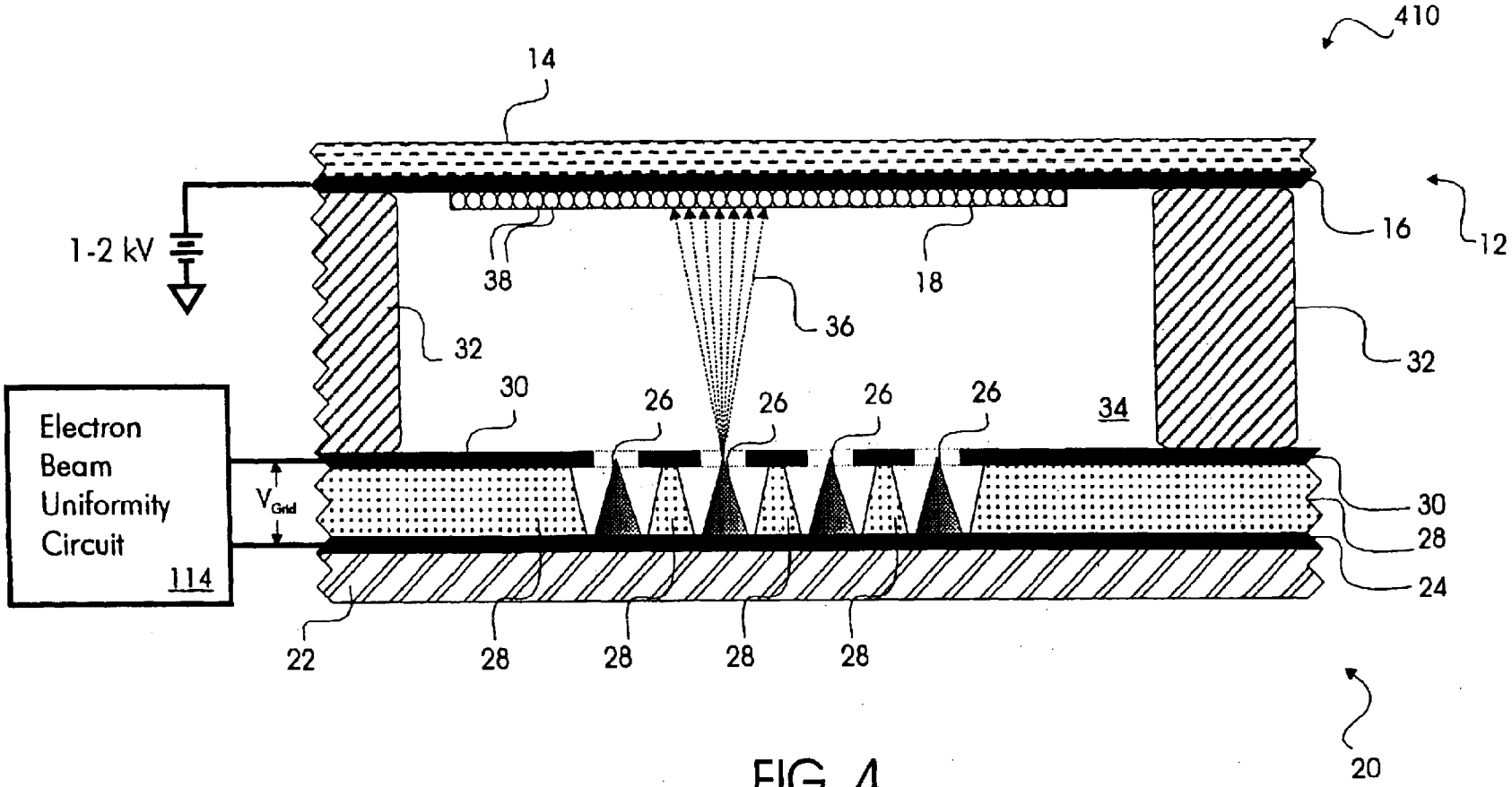
FIG. 4 illustrates a portion of a structural cross-section of an array of micro-tipped cathode emitters in accordance with this invention.

Referring to FIG. 4, a portion of an FED device 410 is shown produced in accordance with this invention including micro-tipped cathode structures. The FED device 410 includes a faceplate 12 and a baseplate 20, separated by spacers 32. The spacers 32 support the FED device 410 structurally when the region 34 in between the faceplate 12 and the baseplate 20 is evacuated. The faceplate 12 includes a glass substrate 14, a transparent conductive anode layer 16 and a cathodoluminescent layer or phosphor layer 18. The phosphor layer 18 may include any known phosphor material capable of emitting photons in response to bombardment by electrons.

The baseplate 20 includes a substrate 22 with a row electrode 24, a plurality of micro-tipped cathodes 26, a dielectric layer 28 and a column electrode 30, also referred to as a gate electrode 30. The baseplate 20 is formed by depositing the row electrode 24 on the substrate 22. The row electrode 24 is electrically connected to a row of micro-tipped cathodes 26. The dielectric layer 28 is deposited upon the row electrode 24. A column electrode 30 is deposited upon the dielectric layer 28 and acts as a gate electrode for the operation of the FED device 410.

The substrate 22 may be comprised of glass. The micro-tipped cathodes 26 may be formed of a metal such as molybdenum, or a semiconductor material such as silicon, or a combination of molybdenum and silicon. Micro-tipped cathodes 26 may also be formed with a conductive metal layer (not shown) formed thereon. The conductive metal layer may be comprised of any well-known low work function material.

The FED device 410 operates by the application of an electrical potential between the column electrode 30 and the row electrode 24 causing field emission of electrons 36 from the micro-tipped cathode 26 to the phosphor layer 18. Electron beam uniformity circuit 114 provides a grid voltage, $V_{Grid}$, sufficient to emit electrons from the micro-tipped cathodes 26 with improved electron beam uniformity over prior art devices. The output of the electron beam uniformity circuit 114, $V_{Grid}$, of the present invention provides a periodic signal superimposed on a DC voltage offset of between about 30 and 110 volts. The periodic signal is chosen with an operating frequency faster than detectable by the human eye. In what is currently considered to be the best mode of the invention, a frequency of about 50 Hertz or greater is sufficient to be undetectable by the human eye. The periodic signal may be sinusoidal, with peak-to-peak voltage excursions of between about 5 volts and 50 volts. Alternatively, the periodic signal may be a rectangular wave also with peak-to-peak variations of between about 5 volts and 50 volts. The duty cycle of the rectangular wave may be between about 10 percent and 90 percent. The circuitry comprising the electron beam uniformity circuit 114 for generating the grid voltage as described above is within the knowledge of one skilled in the art and thus, will not be further detailed.

Transparent conductive anode layer 16 may also be biased to between about 500 volts to about 5000 volts to strengthen the electron field emission. The electrons 36 bombarding the phosphor layer 18, illuminate individual phosphors 38, resulting in visible light seen through the glass substrate 14. The micro-tipped cathodes 26 of FED device 410 are three-dimensional structures which may be formed as evaporated metal cones or etched silicon tips.

Figure 5:
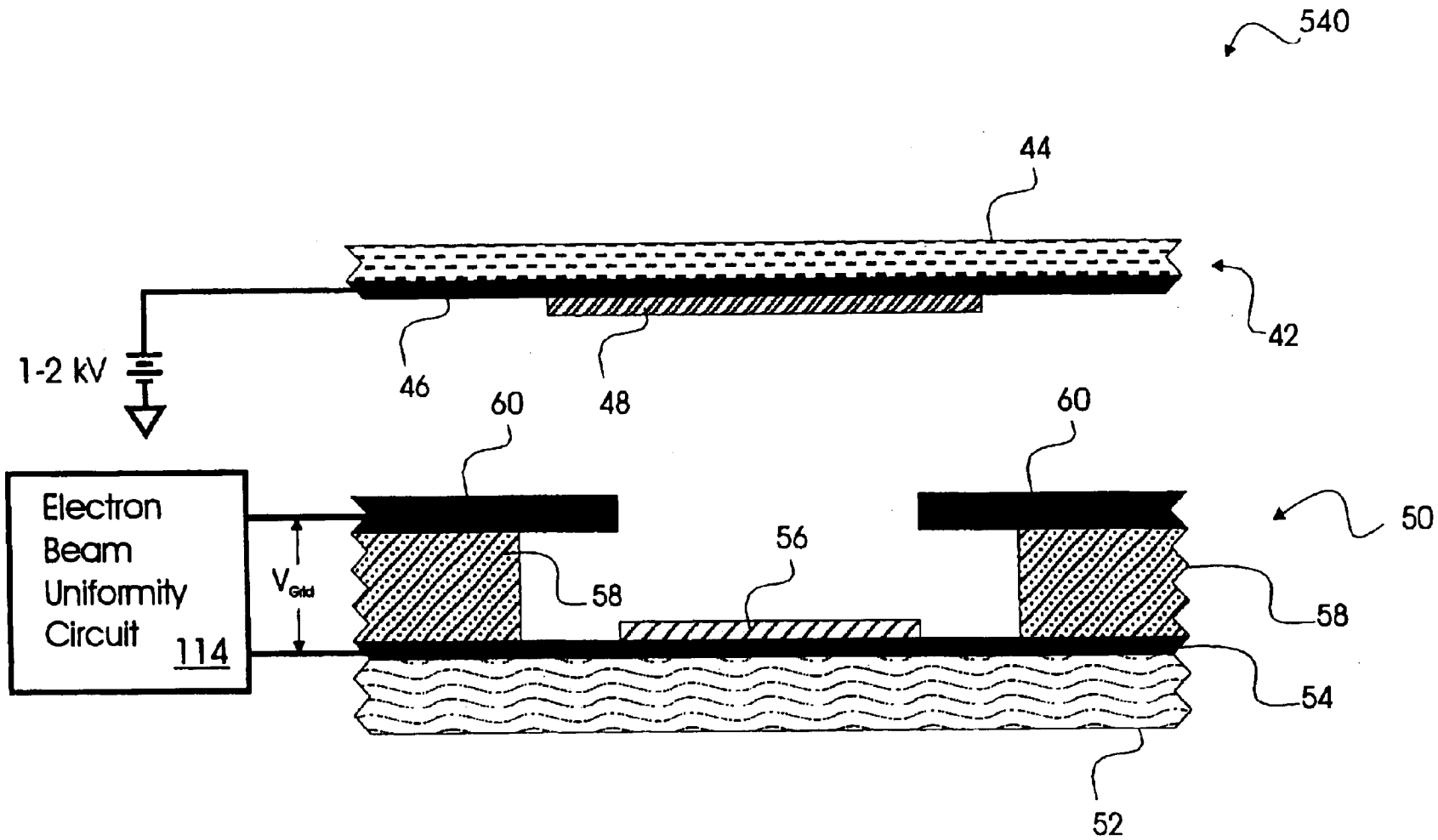
FIG. 5 illustrates a portion of a structural cross-section of an array of flat cathode emitters in accordance with this invention.

Referring to FIG. 5 a portion of an alternative FED device 540 is shown in accordance with this invention including flat cathode structures. FED device 540 includes a faceplate 42 and a baseplate 50 separated by spacers (not shown for clarity). The faceplate 42 may include a glass substrate 44, a transparent conductive anode layer 46 disposed over the glass substrate 44, and a phosphor layer 48 disposed over transparent conductive anode layer 46. An electrical potential of between about 500 volts to about 5000 volts may be applied to the transparent conductive anode layer 46 to enhance the field emission of electrons and gather the emitted electrons at the phosphor layer 48.

The baseplate 50 may include a substrate 52, a conductive layer 54, a flat cathode emitter 56, a dielectric layer 58 and a grid electrode 60. The conductive layer 54 may be a row electrode 54 and is deposited on the substrate 52. The flat cathode emitter 56 and dielectric layer 58 are deposited on the conductive layer 54. The grid electrode 60 may also be referred to as the column electrode 60. The grid electrode 60 is deposited over, and supported by, the dielectric layer 58. The flat cathode emitter 56 may comprise a low effective work function material such as amorphic diamond.

Figure 6:
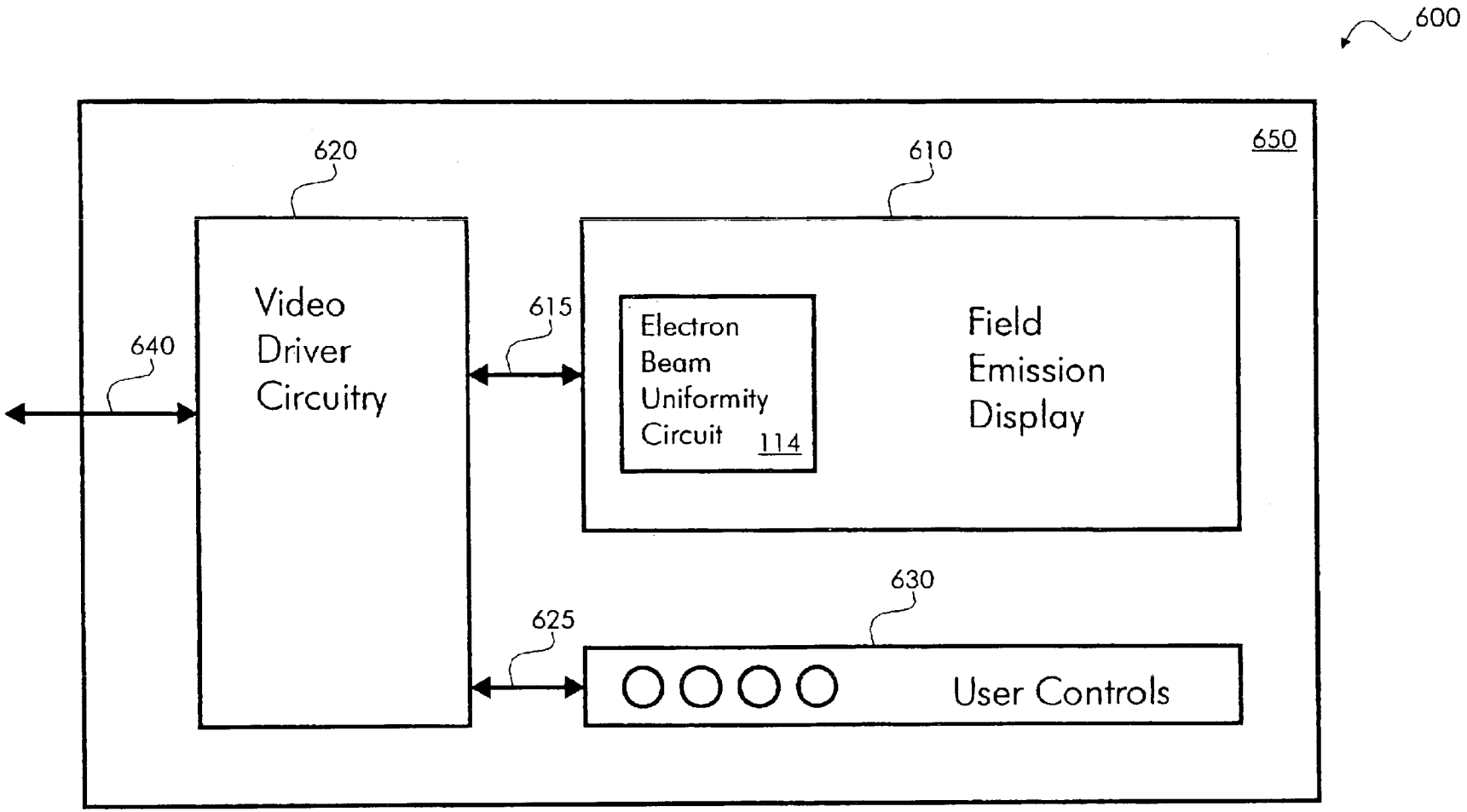
FIG. 6 is a block diagram of a video monitor including an FED in accordance with this invention.

FIG. 6 is a block diagram of a video monitor 600 in accordance with this invention. The video monitor includes an FED 610 coupled 615 to video driver circuitry 620 which is coupled 625 to user controls 630. The FED 610 includes an electron beam uniformity circuit 114 as described herein. The video driver circuitry 620 interfaces 640 with a video controller (not shown). The components of the video monitor 600 are housed in a video monitor chassis 650. Details of how to make and use video driver circuitry 620, user controls 630 and video monitor chassis 650 are within the knowledge of one skilled in the art and thus, will not be further detailed herein.

Figure 7:
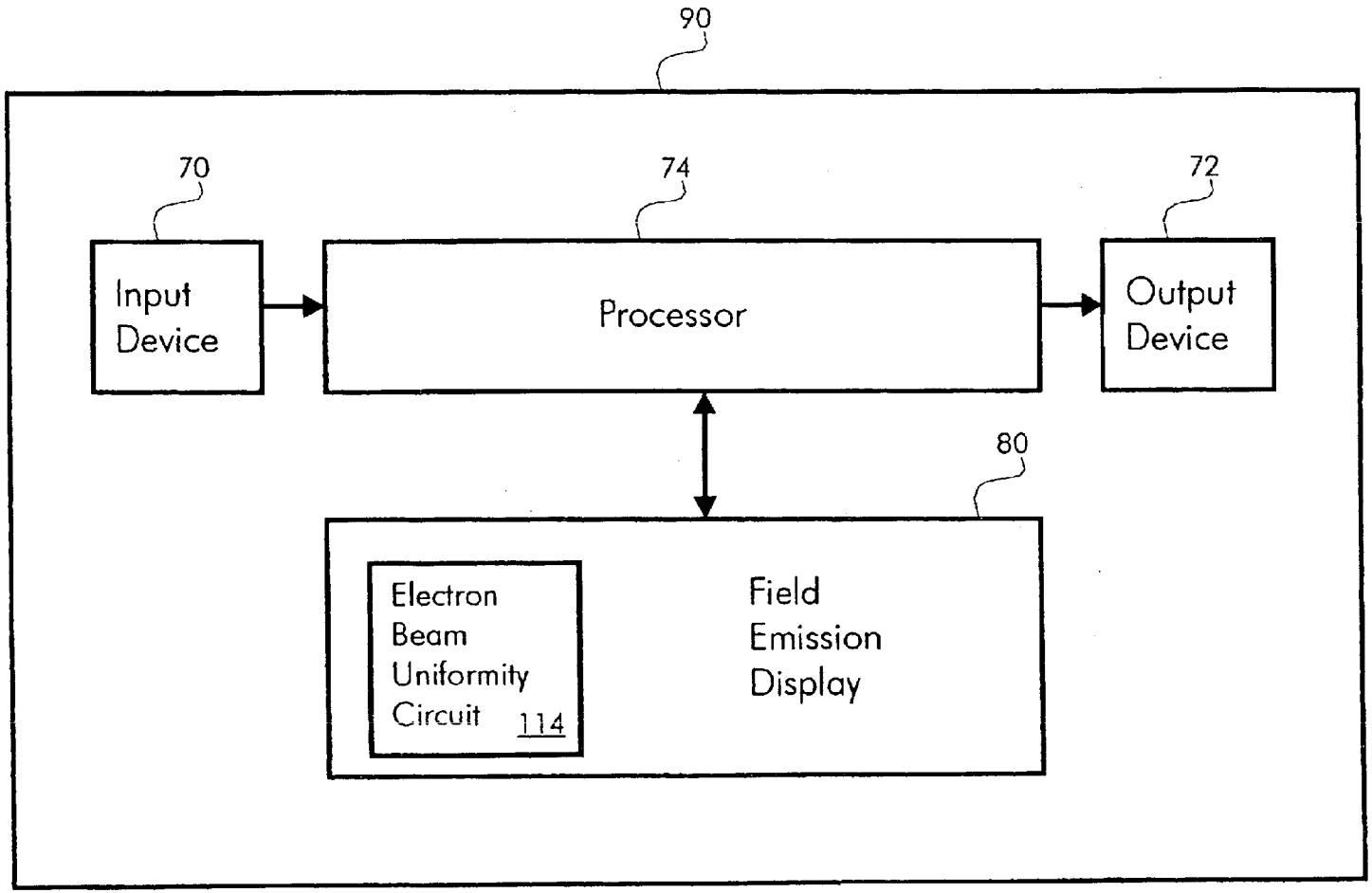
FIG. 7 is a block diagram of a computer system including an FED in accordance with this invention.

FIG. 7 illustrates a block diagram of a computer system 90 including an FED 80 in accordance with this invention. The computer system 90 includes an input device 70, an output device 72, an FED 80 and a processor device 74 coupled to the input device 70, the output device 72 and the FED 80. The FED 80 includes an electron beam uniformity circuit 114 as described herein.

Although this invention has been described with reference to particular embodiments, the invention is not limited to these described embodiments. Rather, it should be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. A circuit for a field emission display comprising:

a row electrode for connecting to a ground potential;

a cathode structure located on the row electrode connected thereto;

a grid electrode having an opening proximate the cathode structure; and an electron beam uniformity circuit connected to the grid electrode for providing a grid voltage, $V_{Grid}$, having a DC offset sufficient to extract electrons from the cathode structure, the grid voltage having a periodic variation in voltage about the DC offset for providing a substantially uniform electron beam from the cathode structure.

2. The circuit of claim 1, wherein the periodic variation in voltage of the arid voltage includes a sinusoidal variation.

3. The circuit of claim 1, wherein the periodic variation in voltage of the grid voltage includes a rectangular wave variation.

4. The circuit of claim 1, further comprising:

a first switching element between the cathode structure and the row electrode gated by an enable signal; and a second switching element between the row electrode and the ground potential gated by row driver circuitry.

5. A field emission display comprising:

a field emitter circuit comprising:

a row electrode for connecting to a ground potential;

a cathode structure located on the row electrode connected thereto;

a grid electrode having an opening proximate the cathode structure; and an electron beam uniformity circuit coupled to the grid electrode for providing a grid voltage, $V_{Grid}$, having a DC offset sufficient to extract electrons from the cathode structure, the grid voltage having a periodic variation in voltage about the DC offset for providing a substantially uniform electron beam; and an anode structure.

6. The field emission display of claim 5, wherein the anode structure comprises:

a transparent conductive anode layer;

a phosphor layer disposed on one side of the transparent conductive anode layer; and a glass layer disposed on another side of the transparent conductive anode layer.

7. The field emission display of claim 5, wherein the periodic variation in voltage of the grid voltage includes a sinusoidal variation.

8. The field emission display of claim 5, wherein the periodic variation in voltage of the grid voltage includes a rectangular wave.

9. A video monitor comprising:

a field emission display including:

a field emitter circuit comprising:

a row electrode for connecting to a ground potential;

a cathode structure located on the row electrode connected thereto;

a grid electrode having an opening proximate the cathode structure; and an electron beam uniformity circuit coupled to the grid electrode for providing a grid voltage, $V_{Grid}$, having a DC offset sufficient to extract electrons from the cathode structure, the grid voltage having a periodic variation in voltage about the DC offset for providing a substantially uniform electron beam; and an anode structure.

10. The video monitor of claim 9, wherein the anode structure comprises:

a transparent conductive anode layer;

a phosphor layer disposed on one side of the transparent conductive anode layer; and a glass layer disposed on another side of the transparent conductive anode layer.

11. The video monitor of claim 9, wherein the periodic variation in voltage of the grid voltage includes a sinusoidal variation.

12. The video monitor of claim 9, wherein the periodic variation in voltage of the grid voltage includes a rectangular wave.

13. A computer system comprising:

a field emission display including:

a field emitter circuit comprising:

a row electrode for connecting to a ground potential;

a cathode structure located on the row electrode connected thereto;

a grid electrode having an opening proximate the cathode structure; and an electron beam uniformity circuit coupled to the grid electrode for providing a grid voltage, $V_{Grid}$, having a DC offset sufficient to extract electrons from the cathode structure, the grid voltage having a periodic variation in voltage about the DC offset for providing a substantially uniform electron beam; and an anode structure.

14. The computer system of claim 13, wherein the anode structure comprises:

a transparent conductive anode layer;

a phosphor layer disposed on one side of the transparent conductive anode layer; and a glass layer disposed on another side of the transparent conductive anode layer.

15. The computer system of claim 13, wherein the periodic variation in voltage of the grid voltage includes a sinusoidal variation.

16. The computer system of claim 13, wherein the periodic variation in voltage of the grid voltage includes a rectangular wave.

* * * * *

UNITED STATES PATENT AND TRADEMARK OFFICE

CERTIFICATE OF CORRECTION

PATENT NO. : 6,940,231 B2
APPLICATION NO. : 10/852319
DATED : September 6, 2005
INVENTOR(S) : Robert T. Rasmussen It is certified that error appears in the above-identified patent and that said Letters Patent is hereby corrected as shown below:

CLAIM 2, COLUMN 6, LINE 44, change “arid” to --grid--

Signed and Sealed this

Sixth Day of November, 2007

JON W. DUDAS
*Director of the United States Patent and Trademark Office*